United States Patent [19]

Inoue et al.

[11] Patent Number: 4,649,710

[45] Date of Patent: Mar. 17, 1987

[54] METHOD OF OPERATING AN AIR CONDITIONER

[75] Inventors: Hidemasa Inoue, Seto; Hisashi Taniguchi, Toyota, both of Japan

[73] Assignee: Trinity Industrial Corporation, Tokyo, Japan

[21] Appl. No.: 804,929

[22] Filed: Dec. 5, 1985

[30] Foreign Application Priority Data

Dec. 7, 1984 [JP] Japan ..... 59-257453

[51] Int. Cl.[4] ..... F25D 17/06

[52] U.S. Cl. ..... 62/92; 62/176.2; 62/223; 62/271; 98/115.2; 165/21; 236/44 C

[58] Field of Search ..... 62/92, 271, 223, 176.2; 98/115.2; 236/44 R, 44 C; 165/21

[56] References Cited

U.S. PATENT DOCUMENTS

| | | | |
|---|---|---|---|
| 3,653,221 | 4/1972 | Angus | 62/223 |
| 3,913,344 | 10/1975 | Holloway et al. | 165/21 |
| 3,989,097 | 11/1976 | Schildknecht | 165/21 |
| 4,103,508 | 8/1978 | Apple | 236/44 R |
| 4,457,357 | 7/1984 | Van Arnhem | 236/44 R |
| 4,562,791 | 1/1986 | Porter et al. | 98/115.2 |

*Primary Examiner*—Ronald C. Capossela

*Attorney, Agent, or Firm*—Cushman, Darby & Cushman

[57] ABSTRACT

In a method of operating an air conditioner for supplying an air from the air conditioner to the inside of a chamber, the temperature of the air supplied to the inside of the chamber upon starting the operation of the air conditioner is increased to an aimed temperature while maintaining the supplied air temperature higher than the temperature at the surfaces of the inner wall of the chamber and/or the equipments installed therein but lower than the temperature the dew point for which is lower than the surface temperature, whereby the moistures contained in the air supplied from the air conditioner is prevented from condensating to form water droplets on the inner wall of the chamber and/or the equipments installed therein. The inside of the chamber can be controlled to an aimed air-conditioned state rapidly without causing undesired dewing phenomenon even during winter or like other cold conditions.

10 Claims, 7 Drawing Figures

METHOD OF OPERATING AN AIR CONDITIONER

BACKGROUND OF THE INVENTION

1. Field of the Invention

This invention concerns a method of operating an air conditioner and, more specifically, it relates to a method of operating an air conditioner particularly upon starting the air conditioner in the winter season or like other cold conditions.

2. Description of the Prior Art

During winter, the temperature inside a chamber, for example, of a coating booth, computer room, clean room and various laboratories to be supplied with conditioned air from an air conditioner is often lowered to about 0°-5° C. before the operation of the air conditioner is started. Accordingly, if the air conditioner is started under such a relatively cold condition to supply a conditioned air at a relatively high temperature as it is into the chamber as described above, the conditioned air is cooled suddenly when brought into contact with the surfaces of inner walls of the chamber and equipment installed therein. In this case, a so-called dewing phenomenon occurs, in which the moisture contained in the air cause condensation to form water droplets on the surfaces of the inner walls or the equipments.

FIG. 1 is a diagram for illustrating the generation of the dewing phenomenon, in which a dry-bulb temperature (°C.) is indicated on the abscissa and the absolute humidity (g/kg') is indicated on the ordinate.

It is assumed here, for example, that an air controlled to a humidity at 80% (refer to curve (I)) which is ideal for a coating booth or the like is supplied at a temperature of 20° C. (point A). Then, the dew point for the air is determined as a crossing point B at about 16° C. between the horizontal extension from the condition point A and the saturation curve (II). Accordingly, if the temperature at the inner wall of the coating booth or the equipments such as a coating machine or a reciprocator installed therein is lower than 16° C., that is, the temperature at the point B, the dewing phenomenon is resulted to form water droplets on the surfaces thereof.

Accordingly, during winter where the temperature in the coating booth is usually lowered to about 0°-5° C., if air conditioned by the air conditioner to a relative humidity of about 80% by humidifying the atmospheric air is supplied, it frequently causes the dewing phenomenon.

Even in a case where the atmospheric air, for example, at about 40% relative humidity is supplied to the coating booth while being conditioned only for the temperature under heating to 20° C. (that is, with no humidification) by using an air conditioner equipped only with a temperature controller, the dew point for the supplied air lies at the temperature on the point E where the horizontal extension from the condition point D for the air intersects the saturation curve, that is, at about 5° C. Also during winter dewing phenomenon tends to occur in the winter season where the temperature inside of the coating booth is usually lowered about to 0°-5° C.

If water droplets are once formed to the surfaces of the inner walls or the coating machines or the likes in the coating booth, dust tends to adhere and contaminate the surfaces and droplets would fall to deposit on the coated films upon working the coating equipments thereby resulting in defective coating. In addition, when the droplets thus formed are evaporated, the humidity in the chamber rises abruptly failing to attain moderate control by the air conditioner for the temperature and the humidity in the chamber.

Accordingly, upon starting the coating operation in the coating booth, it is required to heat the inside of the chamber for a time until a desired temperature is reached and a time for heating to completely evaporate the water droplets deposited to form to the inner wall of the booth or the equipments installed therein is also required. Thus, the method for starting the air conditioner involves an inconvenience that the air conditioner has to be operated preliminarily for one hour or so before starting the operation of the coating booth.

Furthermore, if water droplets are formed on the surfaces of the coating equipments installed in the coating booth as described above or the surfaces of various electronic equipments installed within a computer chamber, rust or electric troubles may resulted to this equipment.

Particularly, in the case of supplying an air at a relatively high temperature and a high relative humidity controlled by an air conditioner equipped with a temperature controller and a humidity controller to the inside of the chamber, the dewing phenomenon occurs most frequency always as described above thereby remarkably causing troubles such as rusting or electrical failures to the equipments.

OBJECT OF THE INVENTION

It is, accordingly, an object of this invention to provide a method capable of preventing the deposition of water droplets, that is, the dewing phenomenon caused by the condensation of moistures contained in an air supplied from an air conditioner to the inside of a chamber upon contact with the surfaces of the inner wall of the chamber or the equipments installed therein when the operation of the air conditioner is started in the winter season or like other cold condition.

SUMMARY OF THE INVENTION

The foregoing object can be attained in accordance with this invention, which comprises a method of operating an air conditioner for supplying an air from the air conditioner to the inside of a chamber, wherein the temperature of the air supplied to the inside of the chamber upon starting the operation of the air conditioner is increased to an aimed temperature while maintaining the supplied air temperature higher than the temperature, at the surfaces of the inner wall of the chamber and/or the equipments installed therein but lower than the temperature the dew point for which is lower than the surface temperature, whereby the moistures contained in the air supplied from the air conditioner is prevented from condensating to form water droplets on the inner wall of the chamber and/or the equipments installed therein.

There is further provided a method of operating an air conditioner equipped with a temperature controller and a humidity controller for effecting the temperature and humidity control to supply a controlled air from the air conditioner to the inside of a chamber, wherein the temperature of the air supplied to the inside of the chamber upon starting the operation of the air conditioner is increased by the temperature controller to an aimed temperature while maintaining the supplied air temperature higher than the temperature, at the surfaces of the inner wall of the chamber and/or the equipments installed therein but lower than the temperature the dew point for which is lower than the surface temperature, and, thereafter, the humidity controller is operated when the supplied air temperature and the surface temperature become substantially identical with each other to thereby humidify the air supplied to the inside of the chamber, whereby the moistures contained in the air supplied from the air conditioner is prevented from condensating to form water droplets on the inner wall of the chamber and/or the equipments installed therein upon starting the operation of the air conditioner.

In accordance with the method of this invention, since the air supplied to the inside of the chamber while being put under the temperature control by a temperature controller disposed in the air conditioner upon starting the operation thereof is maintained at a temperature higher than the temperature at the surfaces of the inner wall of the chamber or the equipments installed therein, these inner walls and the equipments installed are gradually warmed and the surface temperature thereof is gradually increased to a aimed temperature together with the temperature for the supplied air. In addition, since the temperature of the air is always maintained lower than the temperature the dew point for which is lower than the surface temperature as described above, the air upon contact with the surfaces of the inner walls or the installed equipments, is not cooled to lower than the dew point and, accordingly, causes no dewing phenomenon.

Furthermore, in an air conditioner equipped both with a temperature controller and a humidity controller, only the temperature control is effected at first as described above and the humidification is not effected while there is a difference between the temperature for the supplied air and the surface temperature. Since the humidification for the supplied air is started after the temperature difference has substantially been eliminated, if the relative humidity of the supplied air is increased by the start of the humidification to raise the dew point thereof, no dewing phenomenon occur.

BRIEF DESCRIPTION OF THE ACCOMPANYING DRAWINGS

These and other objects, features, as well as advantageous effects of this invention will now be described more in details referring to the accompanying drawings, wherein.

DESCRIPTION OF PREFERRED EMBODIMENTS

This invention is to be described while referring to preferred embodiments.

EXAMPLE I

Figure 1:
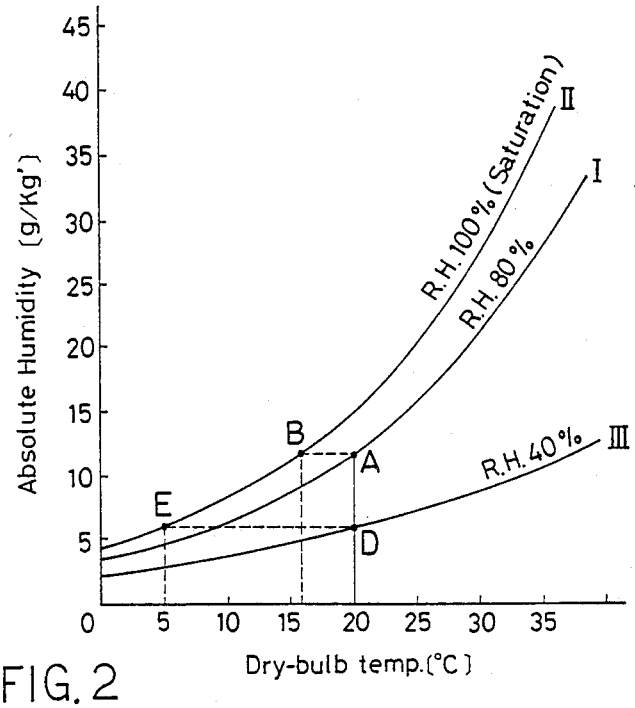
FIG. 1 is a condition diagram for explanating the generation of the dewing phenomenon.
Figure 2:
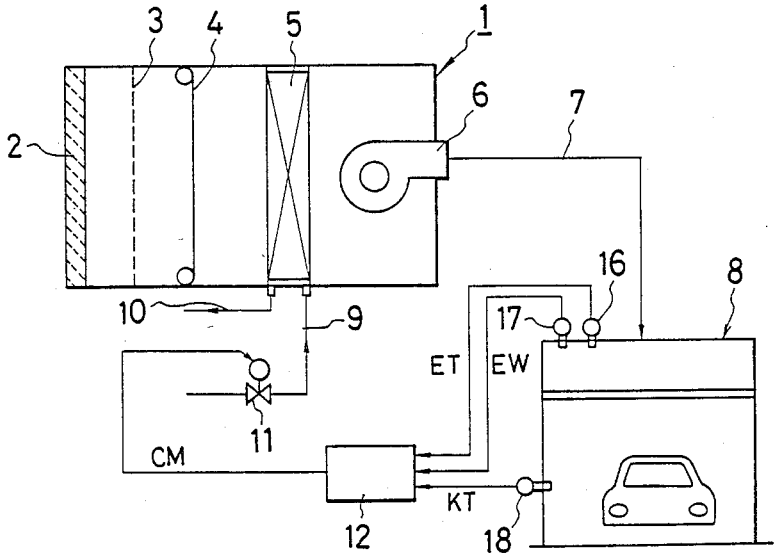
FIG. 2 is a view showing the entire structure of an air conditioner for explanating the method according to this invention.
Figure 3:
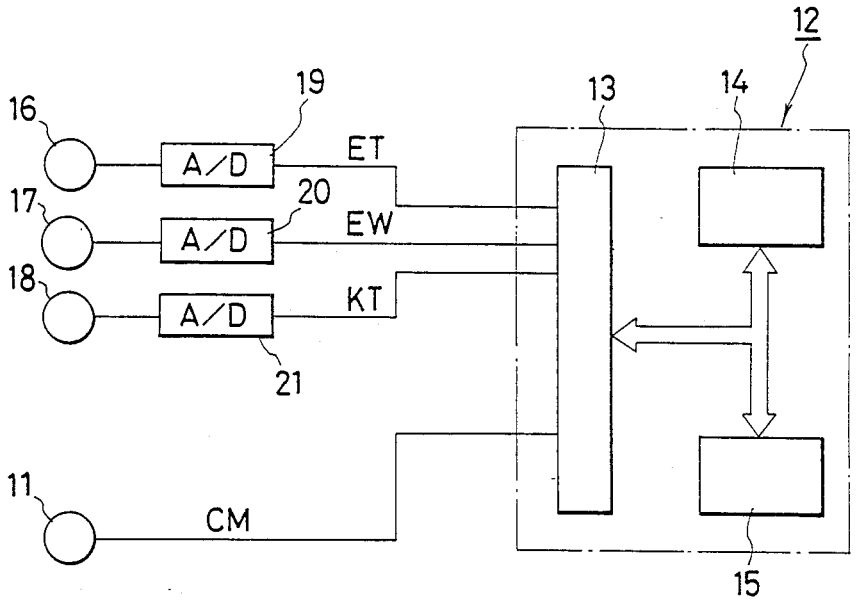
FIG. 3 is an explanatory view for the control device thereof.

FIG. 2 is an explantory view showing one example of an air conditioner used in the method of this invention.

An air conditioner 1 is adapted to eliminate dust contained in the atmospheric air introduced through a gallery 2 by way of a saran net 3 and a roll filter 4, conduct temperature control by heating the cleaned air to an aimed temperature by a temperature controller 5, and then supply the heated air by a blower 6 through an air supply duct 7 to the inside of a coating booth 8 for use in a vehicle coating.

The temperature controller 5 uses, for example, a fin heater of a type that heats air through heat-exchange between an air stream and of warmed water, in which the warmed water is kept under a superatmospheric pressure in a sealed closed expansion tank (not illustrated), so that high temperature water heated to 100°-160° C. is supplied by an introducing pipe 9 and then recycled through a return pipe 10.

A flow rate control valve 11 is inserted at the midway of the introducing pipe 9 and the opening degree of the control valve 11 is adjusted by a control signal CM from a control device 12.

As shown in FIG. 2, the control device 12 is constituted with a microcomputer comprising, for example, an interface circuit 13, a processing device 14 and a memory device 15.

A temperature detector 16 and a humidity detector 17 for detecting the temperature and the humidity of the air supplied from the air conditioner 1, as well as a temperature detector 18 for detecting the temperature at surfaces of the the inner wall of the coating booth 8 and the equipments installed therein are disposed on the inside of the coating booth 8 and connected respectively by way of A/D converters 19, 20 and 21 to the input of the interface circuit 13. The control valve 11 is connected directly to the output of the interface circuit 13.

The processing device 14 performs predetermined processing upon reading the detected data ET, EW and KT from the temperature detector 16, the humidity detector 17 and the temperature detector 18 and outputs the control signal CM for adjusting the opening degree of the control valve 11.

The memory device 15 stores a program for executing the processings in the processing device 14 and also stores the data for the dew point at any of condition points determined by the dry-bulb temperature and the relative humidity, as well as an aimed set temperature RT (for example, at 20° C.).

The procedures for the processing performed by the processing device 14 will now be explained in accordance with the flow chart shown in FIG. 4.

Figure 4:
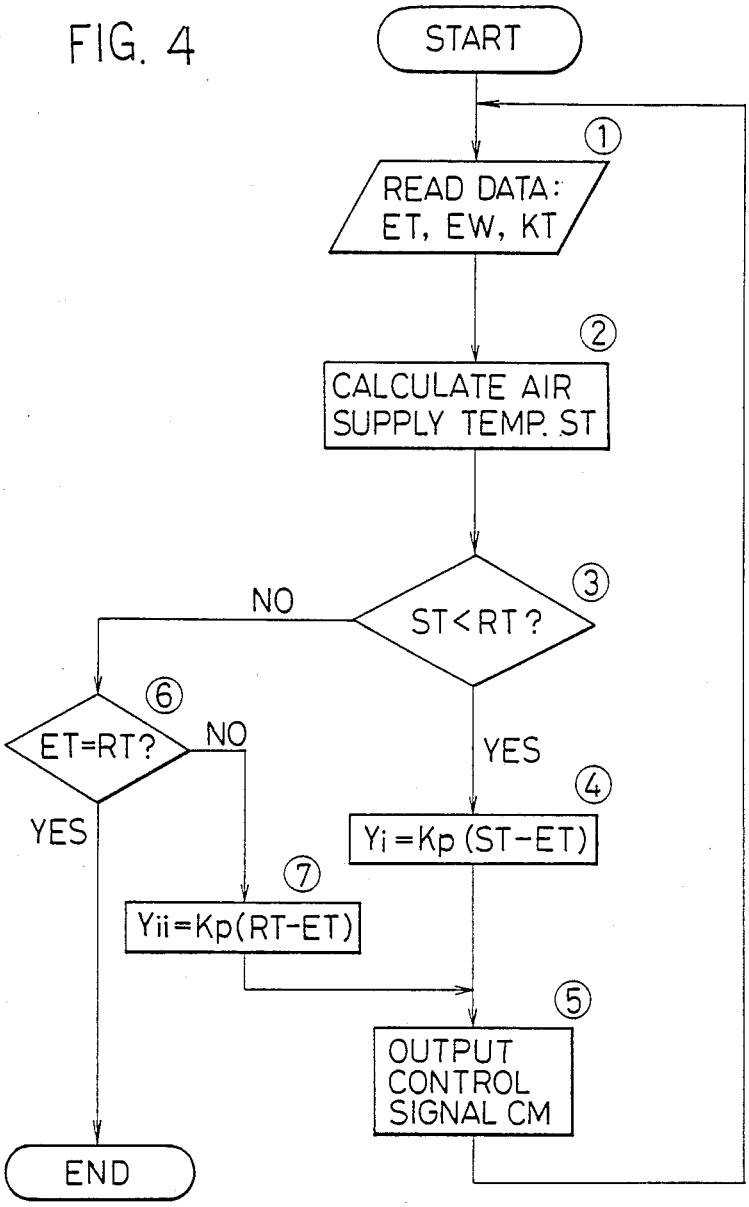
FIG. 4 is a flow chart showing the procedures for the processing steps effected by the control device.

FIG. 4 shows the processing steps for controlling the temperature of the supplied air upon starting the operation of the air conditioner 1. At first in the step (1), upon starting the operation of the air conditioner 1, the temperature detection data ET from the temperature detector 16, the humidity detection data EW from the humidity detector 17 and the temperature detection data KT from the temperature detector 18 are read and the re-

BEST AVAILABLE COPY spective data are temporarily stored to predetermined memory areas in the memory device 15.

Then, the program processes to the step (2), where the respective data stored in the step (1) are read out and the highest supplied air temperature ST that can heat the inside of the coating booth 8 without resulting dew on the surfaces of the inner wall of the coating booth 8 and the equipments installed therein is calculated with reference to the dew point Xt for the condition point determined by the dry-bulb temperature and the relative humidity stored in the memory device 15.

That is, the supplied air temperature ST is calculated as a temperature, which temperature is higher than the surface temperature KT on the inner wall of the coating chamber and the equipments installed therein, but which is lower than a condition point the dew point Xt for which in connection with the relative humidity EW is lower than the surface temperature. The temperature ST is desirably as high as possible within the range determined by the dew point Xt.

Then, the supplied air temperature ST is temporarily stored in a predetermined memory area in the memory device 15.

Then, the program is proceeds to the step (3), where the supplied air temperature ST stored in the step (2) is read out and compared with a desired setting temperature RT stored in the memory device 15 (for example, 20° C.) to judge whether the value for the supplied air temperature ST is lower than the value for the setting temperature RT or not.

If ST is lower than RT (ST<RT), the program is proceeded to the step (4), where a proportional control operation amount Yi (=Kp (ST−ET)), in which Kp represents a conversion constant, is calculated based on the supplied air temperature ST and the temperature detection data ET stored in the predetermined memory area of the memory device 15. Then, the program proceeds to step (5), where a control signal CM, corresponding to the operation amount Yi, is outputted by way of the interface circuit 13 to the control valve 11 and then the flow is returned to the step (1).

In the case where the the supplied air temperature ST is higher than the setting temperature RT(ST≧RT), the program proceeds to the step (6) to judge whether the temperature detection data ET is equal to the setting temperature data RT. If the temperature detection data ET is lower than the setting temperature RT (ET<RT), the program proceeds to the step (7), where a proportional control operation amount Yii (=Kp (RT−ET)) is calculated, which is stored in the predetermined memory area in the memory device 15. Then, the program is proceeded to the step (5), where the control signal CM corresponding to the operation amount Yii is outputted by way of the interface circuit 13 to the control valve 11 Thereafter, the program returns to the step (1). If ET=RT at the step 6, the processing is ended.

The constitution of the air conditioner 1 and the control device 12 used in the method of this invention are as described above and the execution of the method according to this invention will now be explained next referring to FIG. 5.

In a case where the temperature in the coating booth 8 is lowered to 5° C. and the relative humidity is at 70%, for instance, if air is supplied directly at the air supply temperature of 15° C.-20° C. from the air conditioner 1 to the inside of the coating booth 8, since the dew point for the air ranges about from 8° C. to 14° C., the air is cooled within the coating booth to lower than the dew point to result in dewing phenomenon, and the moistures in the air will fall like a mist and form water droplets on the surfaces of the inner wall of the booth and the equipments installed therein. However, if the temperature for the supplied air is controlled to lower than 10° C., no dewing phenomenon is resulted even if the air in the coating booth is cooled down to 5° C. since the dew point in this case is lower than 5° C.

Upon starting the operation of the air conditioner 1 in the winter season, the respective detection data from the temperature detector 16, the humidity detector 17 and the temperature detector 18 in the coating booth 8 are inputted to the control device 12 and the processing device 14 sequentially calculates, based on the detected data, the highest temperature from the temperature range of the detected data from the temperature detector 18 that detects the surface temperature at the inner wall or the equipments, but within a range of temperature as not causing the dewing phenomenon.

Then, a control signal CM is outputted with a proportional control operation amount depending on the calculated supplied air temperature to the control valve 11 that supplies water at high temperature to the temperature controller 5 in the air conditioner 1, thereby increasing the supplied air temperature to an aimed set temperature while adjusting the opening degree of the control valve 11.

As described above according to the method of this invention, upon starting the operation of the air conditioner 1, since the supplied air temperature of the air supplied to the inside of the chamber such as of the coating booth 8 is maintained to such a temperature as not causing dewing even if the air is cooled in contact with the inner wall and the equipments in the chamber, it can provide an advantageous effect of minimizing rusting and electrical troubles to the equipment as experienced so far in the prior art.

Further, since the evaporation of water droplets formed at the surfaces of the inner wall or the equipments as in the prior art is no more necessary, the time required for the preliminary operation can significantly be shortened to remarkably improve the working efficiency.

Moreover, the preliminary operation time can further be shortened by increasing the temperature of the air supplied from the air conditioner 1 to the inside of the coating booth 8 or the like in a state while always maintaining the supplied air temperature at the highest value within the range of temperature not causing the dewing phenomenon.

EXAMPLE II

Figure 5:
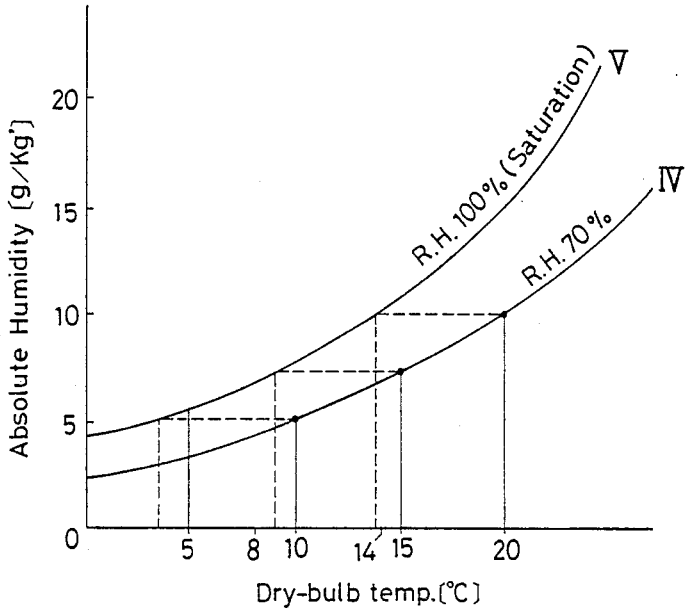
FIG. 5 is a condition diagram for explanating the control of the supplied air temperature according to the method of this invention.

FIG. 5 is an explanatory view showing an embodiment of an air conditioner adapted to perform control both for the temperature and the humidity control, in which the air conditioner 1 is so adapted that atmospheric air introduced through a gallery 2 is eliminated with dusts by way of a saran net and a roll filter 4 and the cleaned air is applied with preliminary heating by a temperature controller 5*a* called as a pre-heater and, further, humidified through a humidity controller 20 comprising a shower type humidifier or the like and then subjected to temperature and humidity control by a temperature controller 5*b* called as a pre-heater, which is supplied by a blower 6 to the inside of the coating booth 8.

Flow rate control valves 11*a* and 11*b* are inserted respectively at the midway of introducing pipes 9*a* and 9*b* for supplying water at high temperature to the temperature controllers 5*a* and 5*b* and the opening degree for the control valves 11*a*, 11*b* are adjusted by a control signal CM from a control device 12.

A flow rate control valve 22 is disposed at the midway of a pipeway 21 supplying warmed water for humidification to a humidifier 20 and the control valve 22 is ON-OFF controlled by a control signal CP from the control device 12.

Since other constitutions are identical with those in the foregoing embodiment, detailed explanations therefor are omitted.

In this embodiment, detection data are inputted from a temperature detector 16, a humidity detector 17 and a temperature detector 18 disposed in a coating booth 8 respectively to the control device 12. Then, based on the detection data, a processing device 14 sequentially calculates the supplied air temperature as a temperature lower than that causing the dewing phenomenon and higher than any of the values of the detection data from the temperature detector 18 for detecting the surface temperature of the inner wall and the equipments.

Then, the control signal CM is outputted with a proportional control operation amount depending on the calculated supplied air temperature, to each of the control valves 11*a*, 11*b* for supplying water at high temperature to the temperature controllers 5*a*, 5*b* in the air conditioner 1 and the supplied air temperature is increased to an aimed temperature while adjusting the opening degree of the control valves 11*a*, 11*b*.

Figure 7:
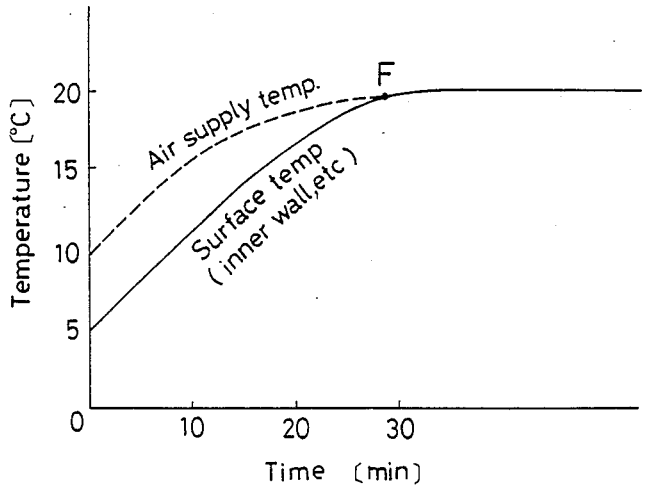
FIG. 7 is a graph showing the time-dependent controlled state for the surface temperature of the inner wall of the chamber and the equipments installed therein and the supplied air temperature according to this method.
Figure 6:
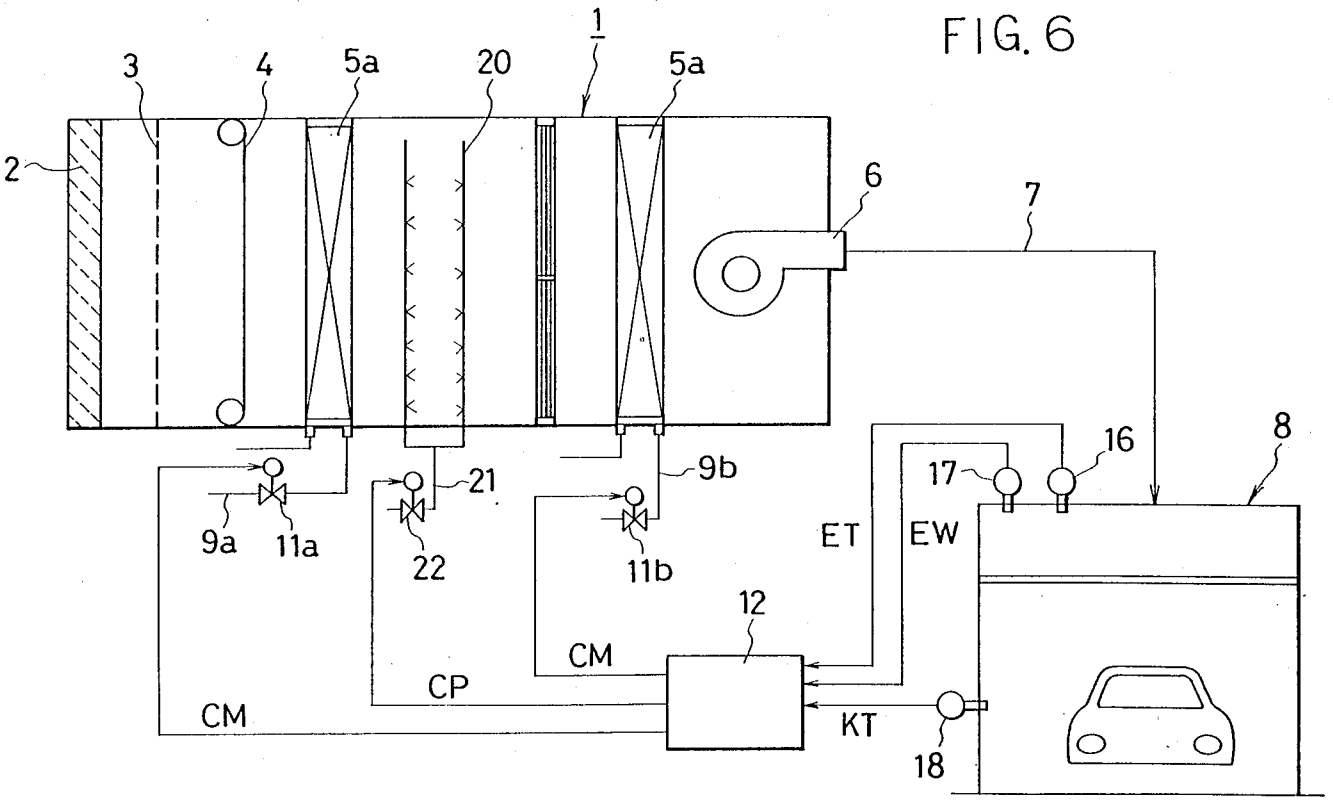
FIG. 6 is a view for the entire structure of the air conditioner for explanating the method of this invention.

Then, at the instance where the supplied air temperature and the value of the detection data from the temperature detector 18 are substantially identical with each other (point F shown in FIG. 7), a control signal CP is outputted from the control device 12 to the control valve 22 inserted to the pipeway 21 for supplying warmed water to the humidity controller 20, to actuate the humidity controller thereby start the humidification.

Thus, the relative humidity of the air supplied from the air conditioner 1 to the inside of the coating booth 8 is increased and, accompanying therewith, the dew point therefor is raised. However, since the temperature for the air and the surface temperature at the inner wall in the coating booth 8 and the equipments installed therein are substantially identical with each other, there is no risk that the air is cooled down below the dew point upon contact with the inner wall and the installed equipments and, accordingly, no dewing phenomenon is resulted.

In the method as described above of this invention, since only the temperature controllers 5*a*, 5*b* are actuated at first at the start of the operation for the air conditioner 1 and the temperature for the air supplied to the inside of the coating booth 8 or the like is increased in a state while maintained to such a temperature as causing no dewing even if the air is cooled by being contact with the inner wall and the equipments in the chamber and, thereafter, the humidifier 20 is actuated to perform humidification when the supplied air temperature and the surface temperature of the inner wall and the equipments are substantially identical with each other, no dewing phenomenon is resulted to the surfaces of the inner wall in the chamber and the equipments installed therein upon starting the operation of the air conditioner 1 and the inside of the chamber can rapidly be controlled for the temperature and the humidity during winter.

As described above, according to the method of this invention, since the air supplied to the inside of the chamber while being under temperature control by the temperature controller disposed in the air conditioner upon starting the operation of the device is maintained at a temperature higher than the temperature at the surfaces of the inner wall in the chamber or the equipments installed therein, the inner wall and the equipments are gradually heated thereby gradually increasing the surface temperature thereof. At the same time, since the air is maintained at such a temperature as the dew point therefor is lower than the surface temperature, the air is not cooled below the dew point and the dewing phenomenon is not caused even the air is in contact with the surfaces of the inner walls or the equipments. Accordingly, it has an excellent effect capable of preventing the troubles such as contamination to the inner wall in the chamber, or generation of rusts or electrical failures to the equipments. Further, it can also provide an advantageous effect that no preliminary operation so far required for evaporating the once condensated moistures is no more necessary and the working efficiency can be improved significantly.

Particularly, in an air conditioner equipped both with the temperature controller and the humidity controller, since only the temperature control is effected at first as described above, while the humidity control is not effected so long as there is a difference between the temperature of the supplied air and the surface temperature but the humidity control is effected at the instance that the temperature difference is substantially eliminated, it has an excellent effect of causing no dewing phenomenon when if an air humidified to a relatively high humidity is supplied to the chamber.

What is claimed is:

1. A method of operating an air conditioner for supplying air from the air conditioner to the inside of a chamber, comprising the steps of:

supplying air to the inside of the chamber;

calculating a temperature of dew point for a surface within said chamber; and increasing a temperature of the air supplied to the inside of the chamber to an aimed temperature upon starting an operation of the air conditioner, while maintaining said supplied air temperature: (a) higher than a chamber temperature, which is a temperature at one of: (1) the surfaces of the inner wall of the chamber and (2) the equipment installed therein, (b) lower than said temperature of dew point, and (c) so that said temperature of dew point is lower than said chamber temperature, whereby the moisture contained in the air supplied from the air conditioner is prevented from condensating to form water droplets in said chamber.

2. A method as in claim 1 comprising the further steps of:

increasing the temperature of the air supplied to the inside of the chamber upon starting the operation of the air conditioner to an aimed temperature while maintaining the supplied air temperature higher than the chamber temperature but lower than a temperature, the dew point for which is lower than the surface temperature; and operating a humidity controller when the supplied air temperature and the surface temperature become substantially identical with each other to humidify the air supplied to the inside of the chamber.

3. A method of operating an air conditioner for supplying air from the air conditioner to the inside of a chamber, comprising the steps of:

detecting a temperature and a moisture content of the air upon initiating an operation of the air conditioner;

continuously calculating the dew point of the air as it is supplied to the inside of the chamber;

detecting a change in a chamber temperature at surfaces of at least one of an inner wall of the chamber and equipment installed in said chamber; and increasing the temperature inside said chamber to a predetermined temperature while maintaining the temperature of said air supplied from said air conditioner to the inside of said chamber such that a dew point of the supplied air is lower than the chamber temperature, while maintaining the temperature of the supplied air to be higher than the chamber temperature, thereby preventing the moisture contained in the air supplied from the air conditioner to said chamber from forming water droplets by condensation at said surfaces of at least one of the inner wall of the chamber and the equipment installed in said chamber.

4. A method as in claim 3, comprising the further step of moistening the air supplied to the inside of said chamber by starting a humidifying operation of said air conditioner when the temperature of said air becomes substantially equal to a temperature at said surfaces.

5. A method of operating an air conditioner to condition the air in a cooled area, comprising the steps of:

detecting a temperature and humidity of a surface within the cooled area;

determining a range of temperatures of air to be supplied to said areas which will not cause dew to be produced on at least one of said surfaces; and supplying air within said range of temperatures.

6. A method as in claim 5 wherein said determining step includes the further steps of:

calculating a dew point temperature corresponding to a dew point of said surface within said cooled area; and determining a range of temperatures in which said dew point is lower than said surface temperature and in which dewing will not occur on said surface.

7. A method as in claim 6 wherein air is supplied at substantially a highest possible temperature within said range.

8. An apparatus for operating an air conditioner to condition air in a cooled area, comprising:

means for detecting a temperature and humidity of a surface within the cooled area;

means for determining a range of temperatures of air to be supplied to said areas which will not cause dew to be produced on one of said surfaces; and means for supplying air within said range of temperatures.

9. An apparatus as in claim 8 wherein said determining means includes:

means for calculating a dew point temperature corresponding to a dew point of said surface within said cooled area; and means for determining a range of temperatures in which said dew point is lower than said surface temperature and in which dewing will not occur on said surface.

10. An apparatus as in claim 9 wherein air is supplied at substantially a highest possible temperature within said range.

* * * * *